United States Patent [19]

Marchetti

[11] Patent Number: 4,457,702

[45] Date of Patent: Jul. 3, 1984

[54] METHOD OF TEMPORARILY IMMERSING ARTICLES IN A HOT-WATER BATH

[76] Inventor: Sergio Marchetti, Via Ottoboni, 10, Milano, Italy

[21] Appl. No.: 347,979

[22] Filed: Feb. 11, 1982

Related U.S. Application Data

[62] Division of Ser. No. 267,755, May 28, 1981, Pat. No. 4,384,849.

[30] Foreign Application Priority Data

Jul. 7, 1980 [IT] Italy ..... 23276 A/80
Oct. 8, 1980 [IT] Italy ..... 25193 A/80

[51] Int. Cl.[3] ..... F27D 3/00; C12C 3/04
[52] U.S. Cl. ..... 432/11; 426/412
[58] Field of Search ..... 426/412; 432/11, 197; 134/75, 83, 130, 133, 134, 154, 182, 183

[56] References Cited

U.S. PATENT DOCUMENTS

| | | | |
|---|---|---|---|
| 797,171 | 8/1905 | Cerruti | 134/130 |
| 1,172,201 | 2/1916 | Egbert | 134/183 |
| 2,714,257 | 8/1955 | Reading | 134/83 |
| 2,745,419 | 5/1956 | Slingerland | 134/154 |
| 2,892,462 | 6/1959 | Ine | 134/133 |
| 3,053,265 | 9/1962 | Erie | 134/133 |
| 3,552,982 | 1/1971 | Savidge | 426/412 |
| 3,812,270 | 5/1974 | Hartz | 426/412 |
| 3,972,679 | 8/1976 | Ruig | 426/412 |
| 4,306,857 | 12/1981 | Hofsetter et al. | 432/197 |

*Primary Examiner*—John J. Camby
*Attorney, Agent, or Firm*—Karl F. Ross; Herbert Dubno

[57] ABSTRACT

Articles—e.g. foodstuffs wrapped in polyethylene bags—to be subjected to heat treatment in a bath of hot water are dropped from an input conveyor into an elongate tank at an inlet end for entrainment by a circulating flow toward an outlet end. A perforated extraction conveyor partly immersed in the water intercepts the entrained articles and lifts them out of the flow onto an output conveyor for drying and subsequent storage. The entering water may be set in vortical motion by convoluted baffles, converging in the flow direction, for insuring full submersion of the articles to be treated.

2 Claims, 4 Drawing Figures

METHOD OF TEMPORARILY IMMERSING ARTICLES IN A HOT-WATER BATH

This is a division of my application Ser. No. 267,755 filed May 28, 1981, now U.S. Pat. No. 4,384,849.

FIELD OF THE INVENTION

My present invention relates to a method of and immersion of articles, especially foodstuffs in heat-shrinkable packages, in a bath of hot water for a limited period.

BACKGROUND OF THE INVENTION

Films of plastic material (e.g. polyethylene) conventionally used for such packaging shrink at temperatures below 100° C. so that the use of a hot-water bath is convenient for this purpose. This is normally done with the aid of a conveyor belt dipping below the bath surface at an immersion point and rising above the water level at an extraction point, the speed of the conveyor being so chosen that articles carried thereon remain submerged for the proper period. When the articles to be sealed in such heat-shrinkable bags are of low weight, however, the packages or at least some of them may float on the surface and may therefore move only slowly if at all to the exit point. This will result in a prolonged exposure of articles to the hot water which could be detrimental especially in the case of foodstuffs.

OBJECT OF THE INVENTION

The object of my present invention, therefore, is to provide a method of and means for the continuous thermal treatment of a series of articles—particularly foodstuffs sealed in heat-shrinkable packages—by immersion in a hot-water bath for a predetermined treatment period with avoidance of any risk of excessive heating.

SUMMARY OF THE INVENTION

In accordance with my present invention, the articles to be treated are deposited in an upwardly open vessel near a hot-water inlet thereof, the water being continuously circulated between the inlet end of the vessel and a remote outlet end to create a unidirectional flow which entrains the deposited articles toward the latter end. The entrained articles are intercepted ahead of the outlet end by a continuously operating conveyor, which is partly immersed in the hot-water flow, for removal from the vessel. Thus, the water acts in the dual role of heating fluid and transport medium.

In order to insure a complete and substantially instantaneous submersion of articles that otherwise might tend to float on the bath surface, I prefer to provide the vessel near its inlet end with turbulence-generating means creating a vortex generally perpendicular to the flow direction in the incoming fluid stream. Such turbulence-generating means may comprise a pair of convoluted baffles which converge in the flow direction and have concave surfaces confronting each other.

BRIEF DESCRIPTION OF THE DRAWING

The above and other features of my invention will now be described in detail with reference to the accompanying drawings in which.

SPECIFIC DESCRIPTION

Figure 1:
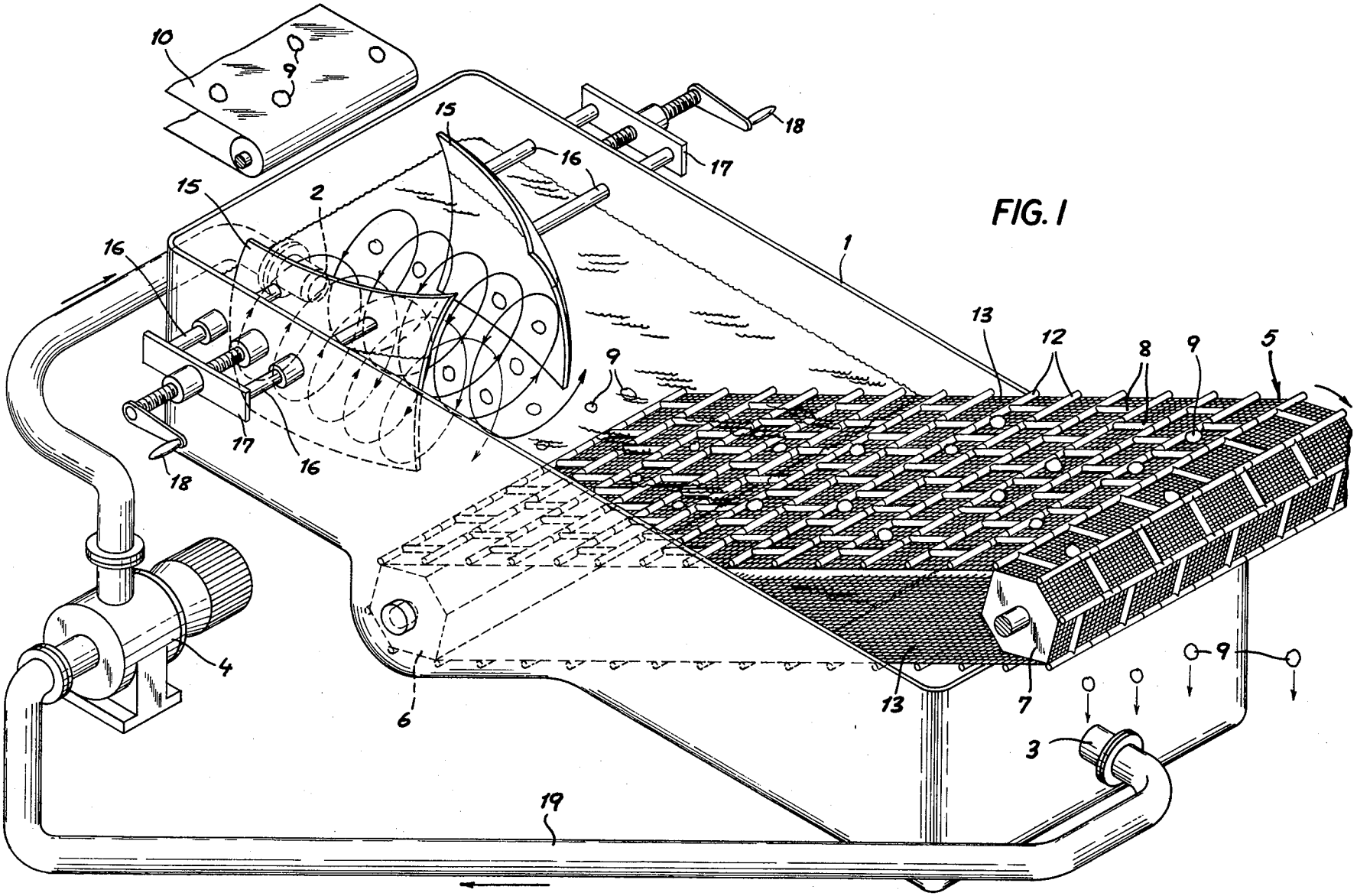
FIG. 1 is a perspective view of part of an apparatus, including an upwardly open vessel, for the heat treatment of articles in accordance with my invention.
Figure 2:
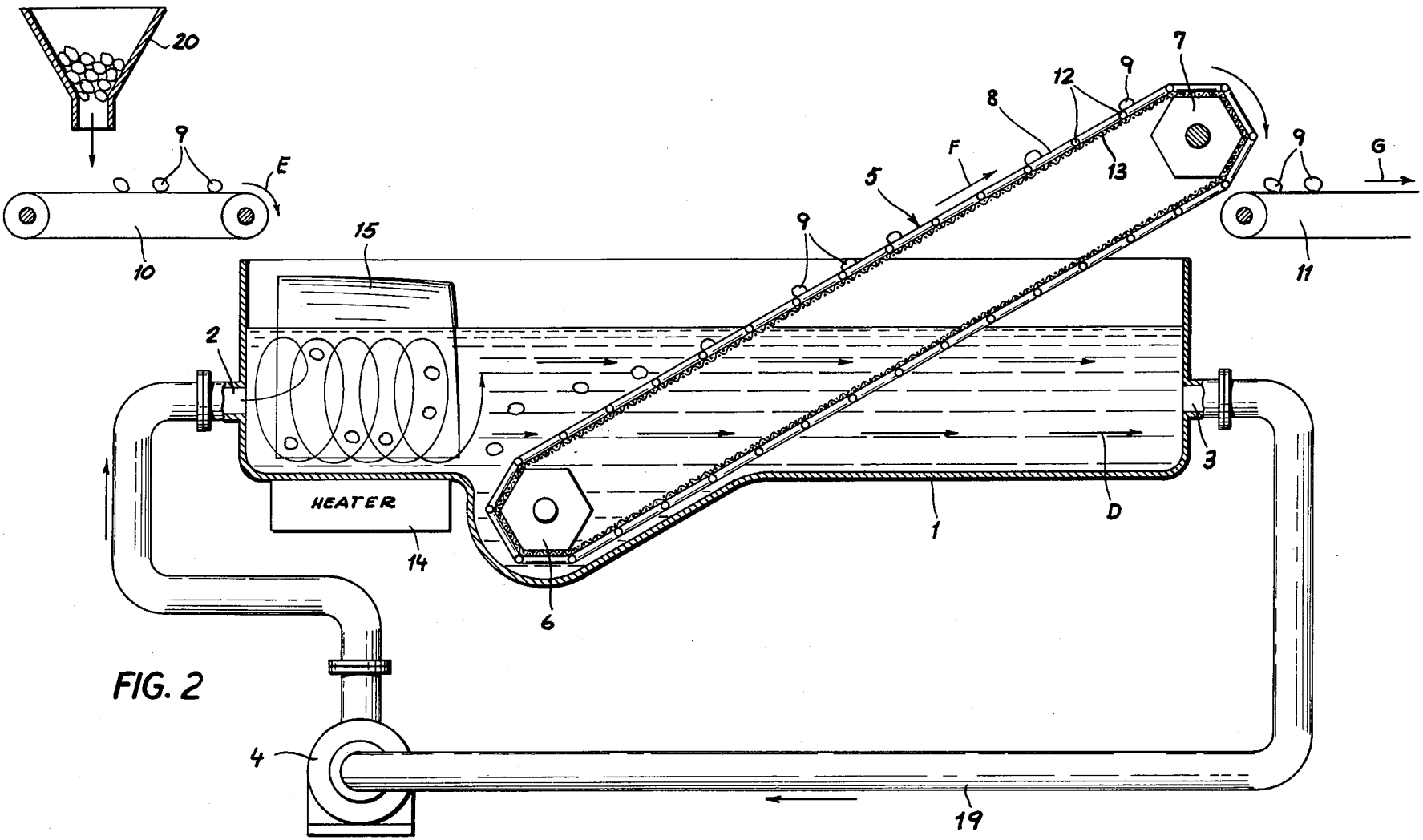
FIG. 2 is a longitudinal sectional view of the vessel of FIG. 1 and also shows, somewhat diagrammatically, other elements of the apparatus.
Figure 3:
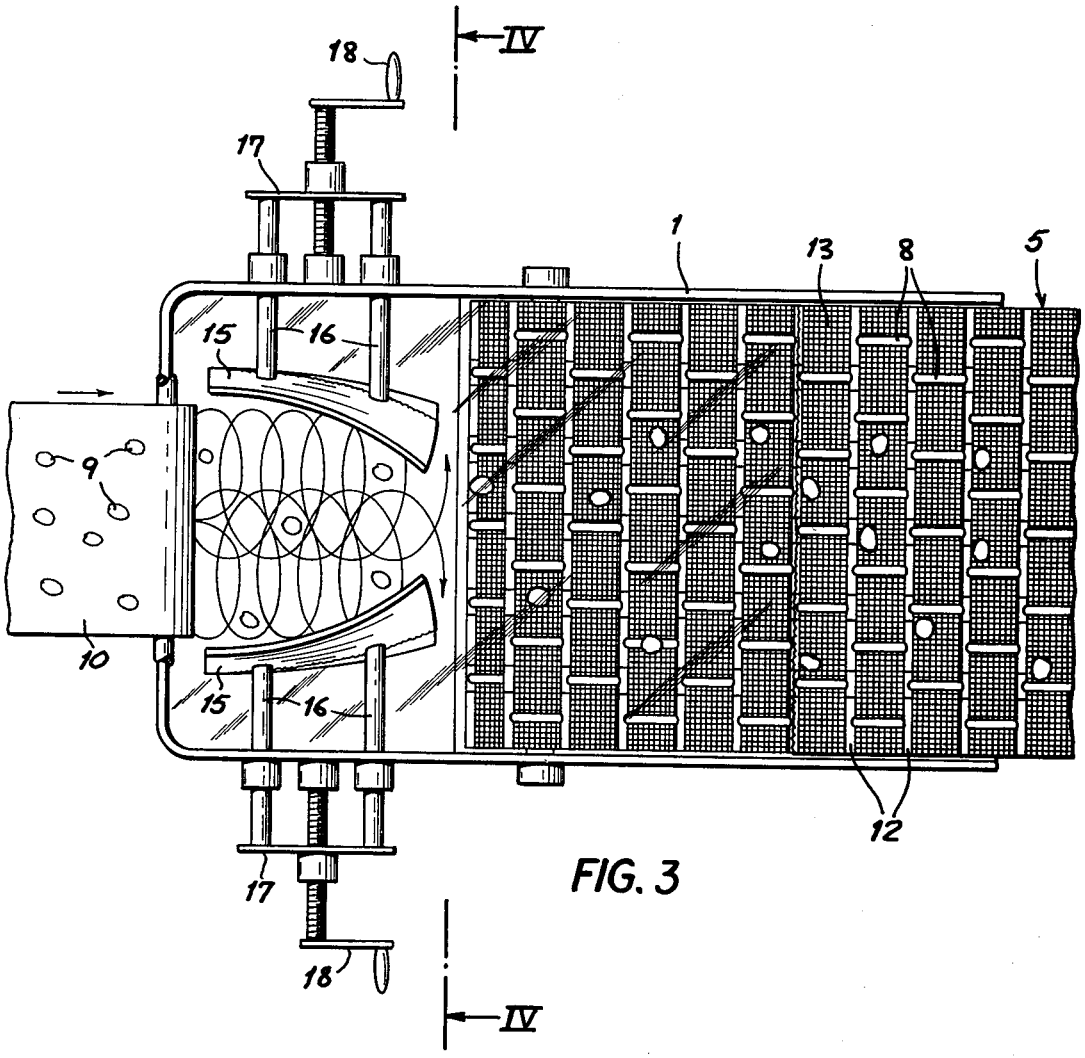
FIG. 3 is a fragmentary top view of the assembly of FIG. 2.

As shown in the drawing, a treatment vessel 1 designed as an upwardly open tank of rectangular outline is provided at one of its short ends with an inlet 2 and at its opposite end with an outlet 3 interconnected by an external conduit 19 including a pump 4 for the continuous unidirectional circulation of a flow of hot water through the vessel. The latter is equipped with a heater 14 for maintaining the water in the tank at a predetermined elevated temperature suitable for the heat-shrinking of polyethylene bags in which foodstuffs are sealed to form articles schematically indicated at 9. These articles are deposited via a hopper 20 on an input conveyor 10, overhanging the inlet end of tank 1, from which they are dropped into the water. Above the outlet end of the tank there is provided an output conveyor 11 overhung by an upper part of an inclined extraction conveyor 5 whose lower part is immersed in the water. All three conveyors are continuously operated, in a direction generally corresponding to that of the water flow as indicated by arrows D, E, F and G, by drive means not further illustrated.

Extraction conveyor 5, whose angle of inclination to the horizontal is shown to be approximately 30°, has longitudinally spaced-apart flights constituted by transverse rods 12 which are interlinked by shorter rods 8 articulated thereto, the network of rods 8, 12 overlying an endless flexible wire grid 13 wound about a lower roller 6 and an upper roller 7. The meshes of grid 13 are, of course, small enough to prevent the articles 9 from traversing same but are sufficiently wide to let the circulating water pass freely through. The immersed part of conveyor 5 intercepts the articles 9 moving with the flow toward outlet 3 and lifts these articles out of the water in order to drop them onto the output conveyor 11 for transportation to a storage bin or some other destination.

Figure 4:
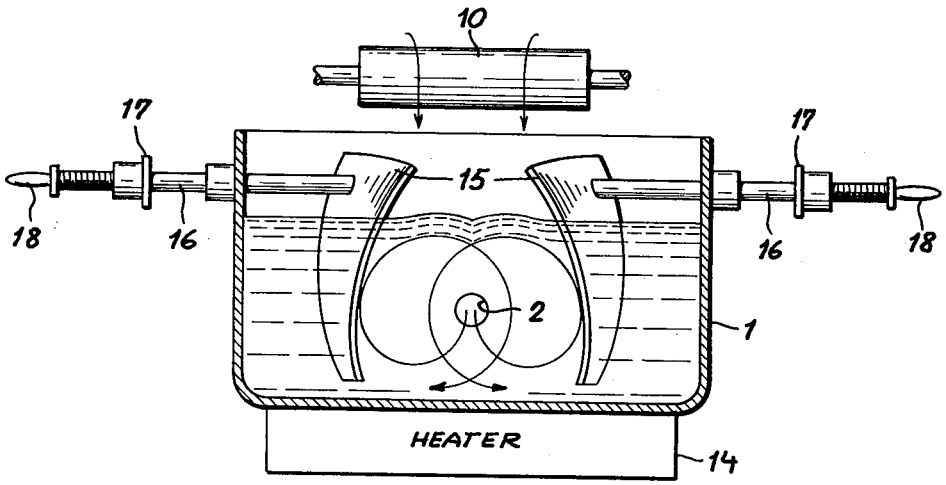
FIG. 4 is a cross-sectional view taken on the line IV—IV of FIG. 3.

As further shown in the drawing, tank 1 is provided near its inlet end with a pair of convoluted baffles 15 which are disposed at opposite sides of input conveyor 10 and converge in the flow direction, these baffles having confronting concave surfaces designed to impart a vertical motion to the incoming flow of hot water. As best seen in FIG. 4, the vortices so generated have downward components near the longitudinal plane of symmetry of the tank whereby the articles 9 dropped from conveyor 10 into the water are immediately drawn under so as to remain submerged until their interception by the rising upper run of extraction conveyor 5. The distance between conveyors 10 and 5 is so chosen, together with the flow velocity of the water, that each article remains in the bath for a period sufficient to shrink the package but not long enough to cause any adverse effects.

The vortex formation can be controlled by a transverse adjustment of baffles 15 which are each shown supported by rods 16 traversing the longitudinal walls of vessel 1 above the water line. The rods 16 are interconnected by a cross-piece 17 threadedly engaging a crank 18 which is rotatably anchored to the vessel wall.

This arrangement, of course, is representative of a variety of equivalent mountings facilitating such an adjustment.

Pump 4 could be replaced by other fluid-circulating means such as, for example, a propeller screw disposed near the outlet 3 underneath the extraction conveyor 5.

I claim:

1. A method of subjecting packaged articles to a heat treatment for predetermined periods, comprising the steps of:

generating a continuous flow of hot water between an inlet end and a remote outlet end of an upwardly open vessel by way of an external conduit interconnecting said ends;

depositing articles to be treated in said vessel at a predetermined location near said inlet end for entrainment by the flow toward said outlet end;

intercepting the entrained articles ahead of said outlet end by a continuously operating conveyor partly immersed in said flow for removal of the articles from the vessel; and imparting turbulence to the flow at said inlet end with creation of a vortex descending at said predetermined location for insuring full submersion of the articles deposited in said vessel.

2. A method as defined in claim 1 wherein said articles are dropped into the vessel from an area overhanging said predetermined location.

* * * * *